US007165829B2

(12) United States Patent
Hayashi et al.

(10) Patent No.: US 7,165,829 B2
(45) Date of Patent: Jan. 23, 2007

(54) LIQUID CONTAINER, LIQUID CONTAINER HOLDER AND RECORDING HEAD CARTRIDGE

(75) Inventors: Hiroki Hayashi, Yokohama (JP); Yasuo Kotaki, Yokohama (JP); Keisuke Matsuo, Yokohama (JP); Tetsuya Ohashi, Matsudo (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 10/766,853

(22) Filed: Jan. 30, 2004

(65) Prior Publication Data

US 2004/0246317 A1 Dec. 9, 2004

(30) Foreign Application Priority Data

Jan. 30, 2003 (JP) ..... 2003/021893

(51) Int. Cl.
*B41J 2/14* (2006.01)
*B41J 2/175* (2006.01)

(52) U.S. Cl. ..... 347/49; 347/86

(58) Field of Classification Search ..... 347/49, 347/85, 86, 87
See application file for complete search history.

(56) References Cited

U.S. PATENT DOCUMENTS 5,359,357 A * 10/1994 Takagi et al. ..... 347/49
6,250,750 B1 * 6/2001 Miyazawa et al. ..... 347/87
6,375,315 B1 * 4/2002 Steinmetz et al. ..... 347/86
6,431,681 B1 * 8/2002 Hatasa et al. ..... 347/19
6,471,334 B1 * 10/2002 Kline et al. ..... 347/49
6,755,516 B1 * 6/2004 Hanson et al. ..... 347/86

FOREIGN PATENT DOCUMENTS

JP 2001-25308 1/2001
JP 2001-253087 9/2001

* cited by examiner

*Primary Examiner*—Anh T. N. Vo
(74) *Attorney, Agent, or Firm*—Fitzpatrick, Cella, Harper & Scinto

(57) ABSTRACT

A liquid container detachably mountable to a container holder, the container holder includes a container body for containing liquid and including a front side engaging portion and a rear side engaging portion for engagement with the container holder, the front side engaging portion and rear side engaging portion being disposed at a leading side and a trailing side, respectively with respect to an inserting direction of the container into the container holder; and a projection, provided on only one of lateral sides of the container body which extend parallel with the inserting direction, for being guided, when the container is mounted to the container holder, along an upper end of a guide wall provided in the container holder while the other lateral side is being limited by an inner surface of the container holder, and the container is being rotated substantially about the front side engaging portion.

7 Claims, 8 Drawing Sheets

(a)

(b)

LIQUID CONTAINER, LIQUID CONTAINER HOLDER AND RECORDING HEAD CARTRIDGE

FIELD OF THE INVENTION AND RELATED ART

The present invention relates to a liquid container for storing liquid such as ink. In particular, it relates to a liquid container, a liquid container holder, and a recording head cartridge, for an ink jet recording apparatus which records letters, pictures, etc., on recording medium by ejecting ink.

There have been proposed various recording heads, for example, a wire dot recording head, a thermal recording head, a thermal transfer recording head, an ink jet recording head, etc., for a recording apparatus for recording images on recording medium, for example, paper, fabric, plastic sheet, OHP (overhead projector) sheet, etc.

Among the recording apparatuses which employ one of the above described recording heads, an ink jet recording apparatus (ink jet printer) has been used as an outputting means (printer) of an information processing system, more specifically, a copying machine, a facsimileing machine, an electric typewriter, a wordprocessor, a workstation, etc., or as a portable printer for a personal computer, a host computer, an optical disc apparatus, an video apparatus, etc.

An ink container for supplying a recording head with ink comprises: a container in which ink is held; an ink absorbing member which absorbs and holds ink, and a lid which keeps the container sealed.

There are two types of recording heads: a recording head integral with an ink container, and a recording head, to which an ink container is removably attachable.

In recent years, various ink jet recording apparatuses, which employ a recording head comprising an replaceable ink container, have come to be widely used, because they have been improved in reliability, and also, they are been reduced in operational cost. Some of them are usable for recording in color, and have a plurality of replaceable ink containers, for example, two replaceable ink containers, four replaceable ink containers, etc. In the case of an ink jet recording apparatus having two replaceable ink containers, one container contains black ink, and the other contains color inks (cyan, magenta, and yellow). In the case of an ink jet recording apparatus having four replaceable ink containers, the four ink containers contain four inks (black, cyan, magenta, and yellow inks), one for one.

In the case of a recording head cartridge employing a single of plurality of replaceable ink containers, it must be assured that ink is reliably supplied from the ink containers of the recording head cartridge to the recording head of the recording head cartridge. Thus, one of the most important prerequisites concerning recording quality is that the ink containers and recording head are accurately positioned relative to each other.

Thus, an ink container and an ink container holder are desired to be structured to assure that the ink container can be easily mounted into the ink container holder. More specifically, they are desired to be structured so that, in order to prevent the ink container and ink container holder from being damaged when mounting the former into the latter, it is made impossible for a user to incorrectly mount the ink container, or forcefully mount the ink container, into the ink container holder. Therefore, an ink container and an ink container holder, in accordance with the prior art (which hereinafter may be referred to as "conventional ink container and ink container holder"), are provided with guiding means for guiding the ink container into the ink container holder.

At this time, the structures of the ordinary conventional ink container and ink container holder (for example, those disclosed in Japanese Laid open Patent Application 2001-253087 corresponding to U.S. Pat. No. 6,375,315) will be described with reference to the appended drawings. FIG. 9 is a side view of the conventional replaceable ink container 102, and FIG. 10 is a bottom plan view of the ink container 102.

As will be evident from FIGS. 9 and 10, the ink container 102 is provided with a pair of guiding projections 140, which are on the side walls, one for one, of the ink container 102, parallel to the direction in which the ink container 102 is mounted into the ink container holder 114, and which engage with the guide rails of the ink container holder 114, which will be described later. These guiding projections 140 project outward of the ink container 102, in the direction perpendicular to the lateral walls 170 of the ink container 102. The ink container 102 is also provided with a pair of outwardly projecting locking claws 142, which are on the front wall of the ink container 102, in terms of the direction in which the ink container 102 is mounted into the ink container holder 114, being next to the bottom wall 176 of the ink container 102. Further, the ink container 102 is provided with a latching lever 130, which is on the rear wall 182 of the ink container 102, in terms of the direction in which the ink container 102 is mounted into the ink container holder 114. The latching lever 130 is provided with a latching claw, which engages with the ink container holder 114, securing thereby the ink container 102 to the ink container holder 114; the latching claw is kept pressured outward, being thereby kept engaged with the ink container holder 114, by the reactive force generated by the resiliency of the latching lever 130 as the lever 130 is pressed inward, that is, toward the rear wall of the ink container 102. The ink container holder 114 will be described later.

The ink container 102 is also provided with a finger tab 144, which is located at the rear end of the top wall of the ink container 102, and which is to be grasped from the rear side of the ink container 102 when inserting the ink container into the ink container holder 114, in order to insert the ink container 102 into the ink container holder 114, from the front wall 172 side of the ink container 102. Further, the ink container 102 is provided with three ink outlets 188, one for each of the three different inks in the ink container 102. The three ink outlets 188 are in the bottom wall 176.

FIGS. 11(*a*), 11(*b*), and 11(*c*) are phantom side views of the combination of the ink container 102 and ink container holder 114, showing the steps for mounting the ink container 102 into the ink container holder 114.

Referring to FIG. 11(*a*), first, the ink container 102 is inserted into the ink container holder 114, from the front wall 172 side. As the ink container 102 is inserted, the pair of guiding projections 140 engage with the pair of guiding rails of the ink container holder 114, one for one. Then, the ink container 102 is horizontally guided by a pair of guiding rails 146, toward the rear wall 166 of the ink container holder 114. During this step, not only the guiding rails 146 horizontally guide the ink container 102 toward the rear wall 166, but also toward the bottom wall 176 of the ink container holder 114, that is, the vertical direction. As a result, the locking claw 142 of the ink container 1021*s* caught by the locking claw 148 of the rear wall 166 of the ink container holder 114, as shown in FIG. 11(*b*).

Next, the ink container 102 is pressed downward as indicated by an arrow mark X in FIG. 11(*b*). As a result, the ink container 102 is pushed into the ink container holder 114, while being rotated in such a manner that the rear end portion, that is, rear wall 182 portion, of the ink container 102 comes into contact with the bottom surface 168 of the ink container holder 114. As the ink container 102 is pushed downward into the ink container holder 114, the latching lever 130 is temporarily bent toward the rear wall 182 of the ink container 102.

Then, at virtually the same moment as the rear end (wall 182) of the ink container 102 comes into contact with the bottom wall 168 of the ink container holder 114, the latching claw 154 of the latching lever 130 engages into the latching level locking hole 150 of the ink container holder 114, securing the ink container 102 to the ink container holder 114 while accurately positioning the ink container 102 relative to the ink container holder 114, as shown in FIG. 11(*c*).

Also referring to FIG. 11(*c*), as the ink container 102 is properly mounted into the ink container holder 114, the ink supply tube 136 presses on a porous member (unshown), as an ink holding member, in the ink container, making the portion of the porous member, in the adjacencies of the ink supply tube 136, greater in capillarity. The portion of the porous member, which is greater in capillarity, draws ink toward the ink supply tube 136 so that the ink is supplied to a recording head (unshown) through the ink supply tubes 136.

On the other hand, when removing the ink container 102, the latching lever 130 is to be temporarily bent toward the rear wall 182 of the ink container 102 against the resiliency of the lever 130 in order to disengage the latching claw 154 from the latching lever locking hole 150. Then, the ink container 102 is to be pulled upward by the finger tab 144 of the ink container 102 until the bottom rear end of the ink container 102 comes out of the ink container holder 114. After the rear end of the ink container 102 comes out of the ink container holder 114, the finger tab 144 of the ink container 102 is to be grasped and pulled in the direction opposite to the direction in which the ink container 102 is inserted into the ink container holder 114, in order to pull the ink container 102 out of the ink container holder 114. As the ink container 102 is pulled in the above described direction, the guiding projections 140 of the ink container 102 slide on the guiding rails 146, one for one, raising thereby the ink container 102 away from the bottom wall 168 of the ink container holder 114. As a result, the ink supply tubes 136 are moved out of the ink outlets 188 of the ink container 102, being thereby prevented from interfering with the removal of the ink container 102.

The above described conventional ink container and ink container holder, however, suffer from the following problems.

That is, the ink container and ink container holder for a portable printer need to be small, because a portable printer needs to be small in overall size. Therefore, they need to be structured so that they are smaller in the amount of the space required for mounting the ink container into the ink container holder, or removing the ink container therefrom.

In the case of an ink container holder such as the above described conventional one, however, the overall size of an ink container holder is substantially affected by the thickness of its walls of the ink container holder positioned in a manner to surround each of the ink container held by the holder, and also, by the width of its guiding rails; in other words, the thickness of the walls of the ink container holder and the width of the guiding rails of the ink container holder impose limits on the size reduction of a conventional ink container holder.

In addition, in the case of some of conventional ink container holders capable of accommodating multiple ink containers, a black ink container mountable therein is different from each of color ink containers mountable therein, in terms of the movement they make when they are mounted into an ink container holder. Thus, it is quite difficult to realize an ink container holder which is substantially smaller than a conventional ink container holder, and yet, is capable of preventing the problem that a recording head, etc., become damaged by being incorrectly mounted.

Further, an idea of modifying a conventional ink container in design so that the ink container will not come into contact with an ink container holder when it is mounted into the ink container holder has been taken into consideration, as a means to prevent an ink container holder, etc., from being damaged when an ink container is mounted into the ink container holder. However, this idea is problematic in that it reduces the internal volume, that is, ink capacity, of an ink container.

SUMMARY OF THE INVENTION

Thus, the primary object of the present invention is provide a liquid container, which is substantially smaller than a liquid container in accordance with the prior art, and which can be reliably mounted into an ink container holder, without being damaged, or damaging the ink container holder, even if it is incorrectly mounted into the ink container holder.

Another object of the present invention is to provide a liquid container, which is substantially smaller than a liquid container in accordance with the prior art, is compatible with a recording apparatus substantially smaller in size than a recording apparatus in accordance with the prior art, and yet, is not substantially smaller in liquid capacity than a liquid container in accordance with the prior art, can be reliably mounted into an ink container holder, and is reliable in liquid delivery.

According to the present invention made in order to accomplish the above described objects, a liquid container removably mountable in an ink container holder comprises a front locking portion and a rear locking portion, and a container proper for containing liquid. Only one of the lateral walls of the container proper, parallel to the direction in which the liquid container is inserted into the liquid container holder, is provided with a projection. When the liquid container is mounted into the liquid container holder, the liquid container rotates about the front locking portion thereof, with the projection being guided by the top edge of the guiding wall of the liquid container holder, whereas the other side of the liquid container, that is, the side opposite to where the projection is located, being regulated by the internal surface of the corresponding lateral wall of the liquid container holder.

When a liquid container structured as described above in accordance with the present invention is mounted into a liquid container holder structured as described above in accordance with the present invention, the projection on one of the lateral walls of the liquid container, parallel to the liquid container insertion direction, is guided by the top edge of the guiding wall of the liquid container holder, and the other lateral wall of the liquid container is regulated by the internal surface of the liquid container holder. Therefore, as the liquid container is mounted into the liquid container holder, it rotates about the front locking portion. Further, as the liquid container is mounted into the liquid container holder, the front and rear locking portions of the liquid container engage with the liquid container holder. In other words, according to the present invention, the space occupied by one of the pair of guiding projections on the two lateral walls, parallel to the liquid container insertion direction, of a liquid container in accordance with the prior art, can be eliminated. Therefore, not only is it possible to reduce the size of a liquid container while assuring that the liquid container is reliably mounted into a liquid container holder, but also to assure that even if the liquid container is incorrectly mounted into a liquid container holder, the liquid container holder, etc., are not damaged.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

Figure 1:
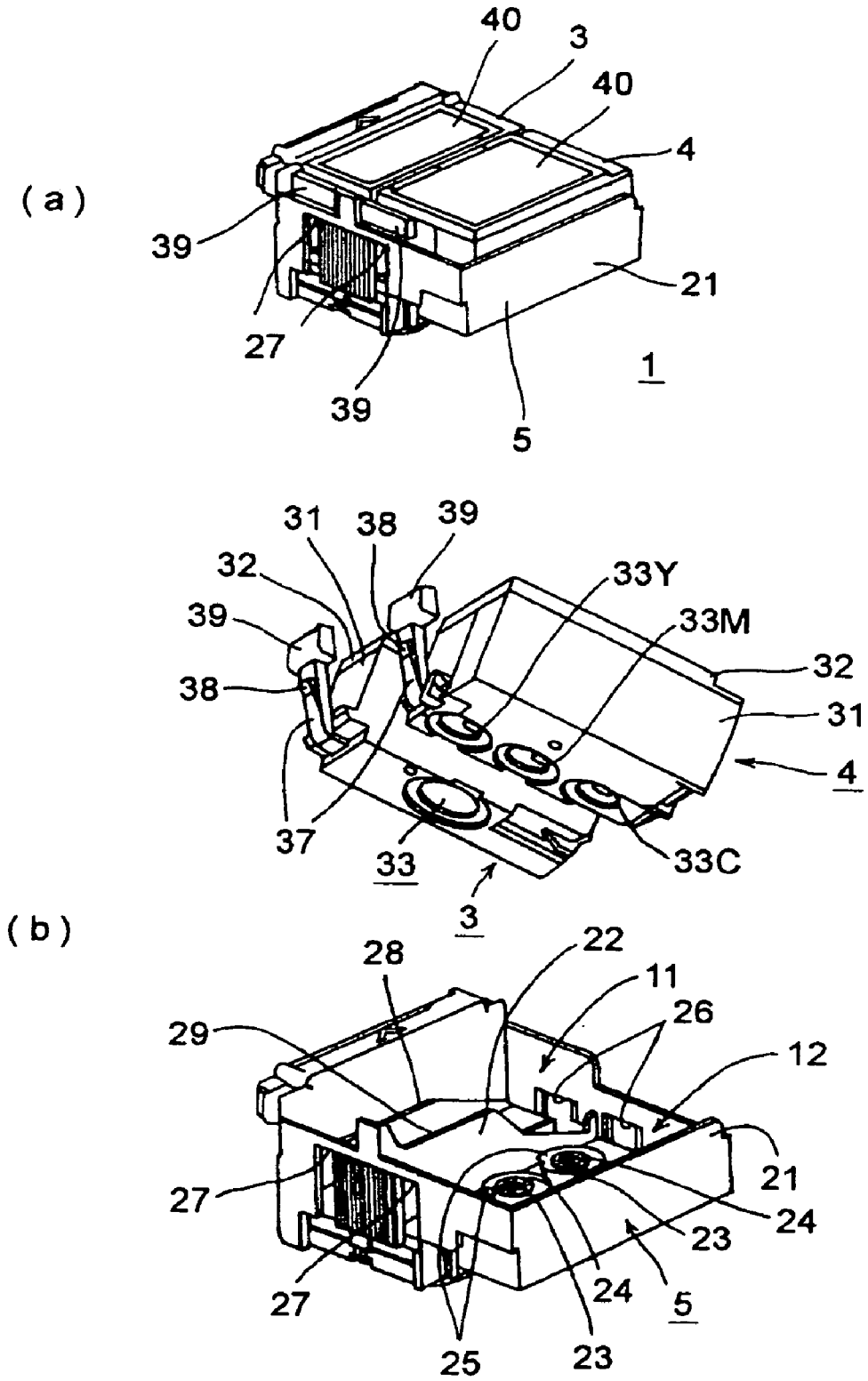
FIG. 1 is a perspective view of the ink jet recording head cartridge in the first embodiment of the present invention; (a) showing the ink container in the ink container holder, and (b) showing the ink container having been removed from the ink container holder.
Figure 2:
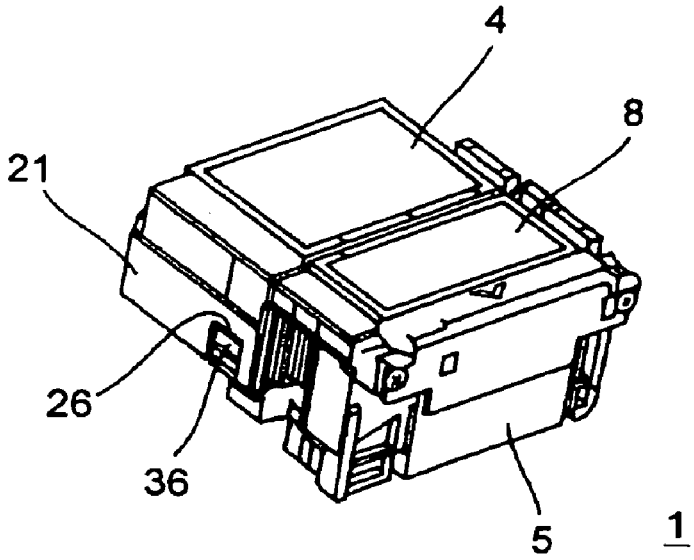
FIG. 2 is a perspective view of the ink jet recording head cartridge shown in FIG. 1; (a) showing the ink container in the ink container holder, and (b) showing the ink container having been removed from the ink container holder.
Figure 2:
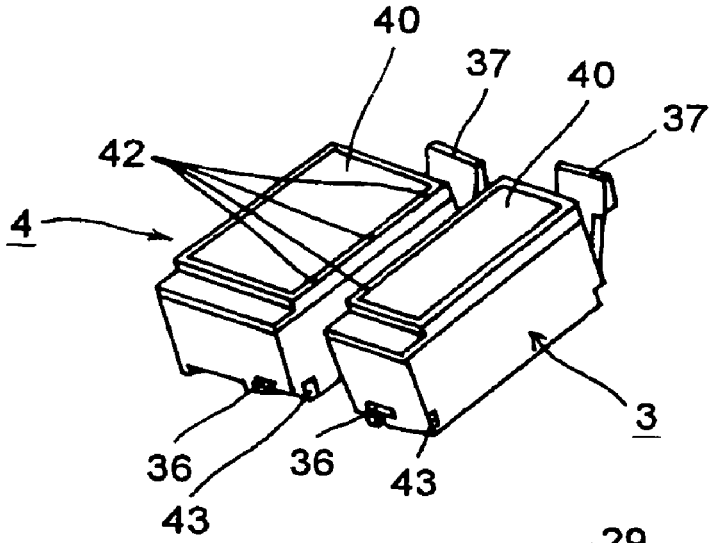
Figure 2:
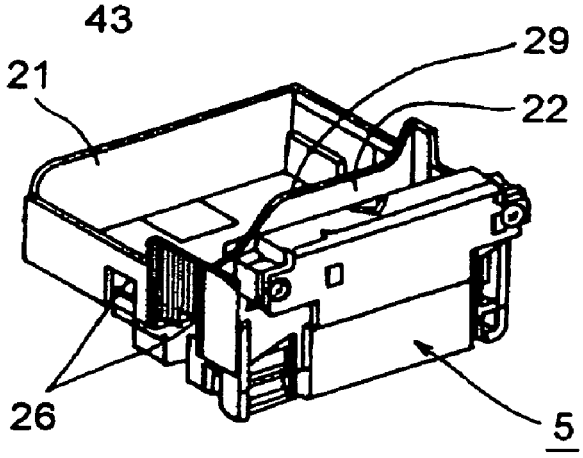
Figure 3:
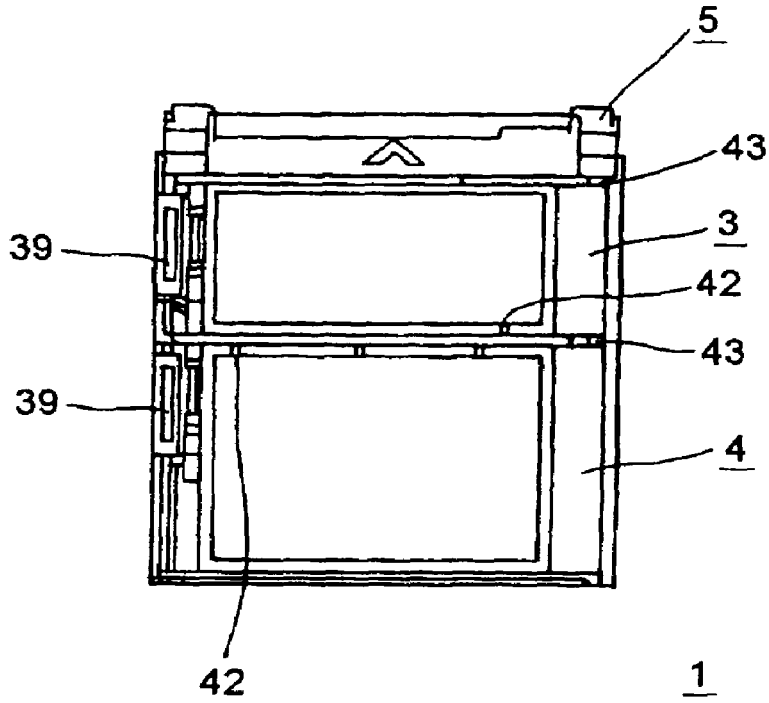
FIG. 3 is a plan view of the ink jet recording head cartridge shown in FIG. 1.

FIGS. 1 and 2 are perspective views of the recording-head cartridge in the first embodiment of the present invention. FIG. 1(*a*) shows the recording head cartridge in the ink container holder, and FIG. 1(*b*) shows the recording head cartridge, which is not in the ink container holder. FIG. 2 shows the recording head cartridge as seen from the side opposite to the side from which the cartridge is seen in FIG. 1. FIG. 3 is a plan view of the recording head cartridge.

As will be evident from FIGS. 1, 2, and 3, the recording head cartridge 1 in this embodiment comprises: a recording head (unshown) for ejecting ink; a black ink container 3 for supplying the recording head with black ink; a color ink container 4 for supplying the recording head with color inks; and an ink container holder 5 into which the black ink container 3 and color ink container 4 are removably mountable.

The recording head, which is not shown, is attached to the ink container holder 5, and has plural rows of nozzles for ejecting ink, and plural electrically resistant elements for generating the thermal energy for ejecting the ink supplied from an ink container. The plural rows of nozzles are different in the color of the ink they eject. The recording head forms an image by ejecting ink with the use of the thermal energy generated by the electrically resistant elements; the so-called film-boiling phenomenon is used to eject ink.

Obviously, the application of the present invention is not limited to the above described ink ejection mechanism. For example, it is also applicable to some of the well-known ink ejection mechanisms, in accordance with the prior art, such as an ink ejection mechanism which employs a piezoelectric ink ejection system, an ink ejection mechanism structured to use electrical charge, and the like ink ejection mechanism.

Referring to FIG. 1(*b*) and FIG. 2(*b*), the ink containers 3 and 4 are provided with a container proper 31 and a lid 32. The container proper 31 is in the form of a box, which cannot be open on the bottom side, and has a storage chamber in which ink is to be held. The lid 32 is for covering the opening (unshown) of the container proper 31.

The lid 32 has through holes (unshown), and labyrinthine grooves (unshown). The through holes reach inward of the ink containers 3 and 4 from outside the lid 32. The labyrinthine grooves are in the outward surface of the lid 32, and extend from the through holes to the peripheries of the lid 32. The labyrinthine grooves are covered with a sheet 40 so that they are exposed to the ambient air only at the peripheries of the lid 32; air vents are provided. With the provision of this structural arrangement, it is possible to minimize the amount by which the inks in the ink containers 3 and 4 evaporate from the air vents 42; virtually no inks in the ink containers 3 and 4 evaporate from the air vents 42. The bottom wall of the container proper 31 is provided with a plurality of ink outlets 33 through which inks are supplied to the ink container holder 5 side.

The ink container holder 5 is provided with a plurality of ink delivery tubes 23 through which ink is taken in from the ink containers 3 and 4. The ink delivery tubes 23 are in the bottom walls of the first and second ink container compartments 11 and 12, which will be described later. Each ink delivery tube 23 is provided with a filter 23, which is located at one end of the ink delivery tube 23. It is in the formed of a chimney. As the ink container 3 (4) is mounted into the ink container holder 5, the filter 24 of each ink delivery tube 23 of the ink container holder 5 is placed in contact with the ink retaining portion located inward of the corresponding ink outlet 33 of the ink container 3 (4), and the elastic members 25 attached to the ink container holder 5 so that they surround ink delivery tubes 23, one for one, airtightly seal between the adjacencies of the ink outlets 33 and the adjacencies of the ink delivery tubes 23, one for one, preventing ink from evaporating or leaking, and therefore, making it possible for ink to be desirably delivered to the recording head. In order to assure that the adjacencies of the ink outlets 33 and ink delivery tubes 23 are airtightly sealed, the elastic members 25 may be shaped so that their cross sections, parallel to the direction in which they are compressed, look like the cross section of the bell portion of a trumpet, parallel to its axial direction. Obviously, a piece of sealing tape or a rubber plug may be used instead of the elastic member 25; ink outlet is sealed with the sealing tape or rubber plug, which will be penetrated by the needle-tipped ink delivery tube of the ink container holder, when an ink container is mounted into the ink container holder. In other words, the elastic member 25 may be replaced with a component different in structure from the elastic member 25, as long as the ink delivery (supply)-joint between the ink container and ink container holder 5 remains airtightly sealed.

Next, the structures of the black ink container 3 and color ink container 4 will be described in more detail with reference to the appended drawings.

Figure 4:
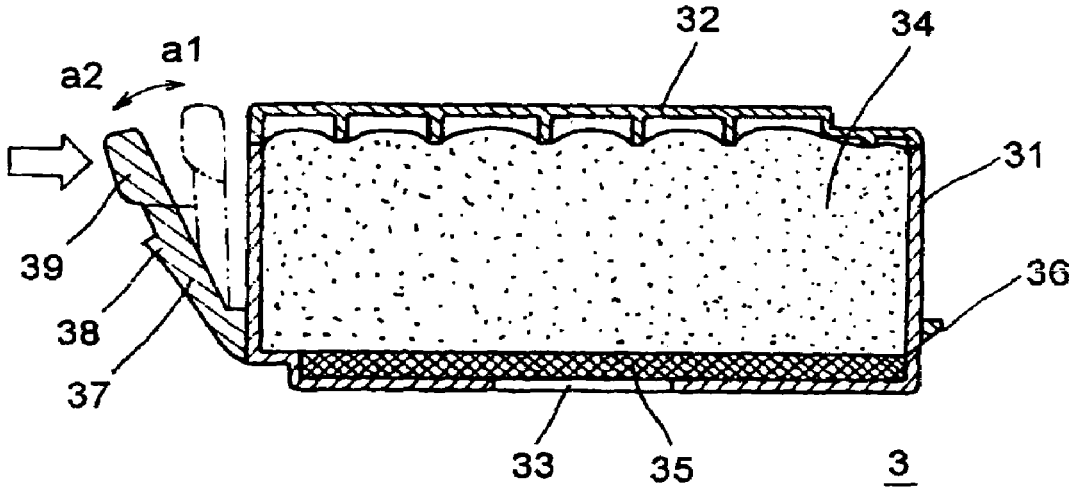
FIG. 4 is a sectional view of the black ink container.
Figure 5:
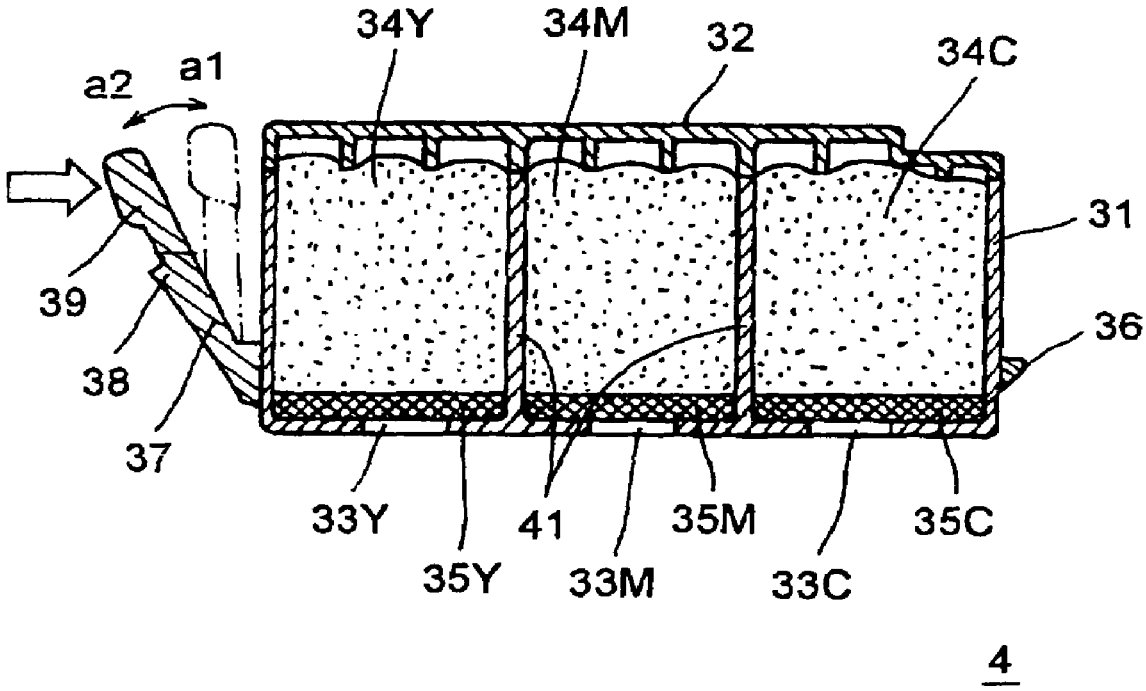
FIG. 5 is a sectional view of the color ink container.

FIG. 4 is a sectional view of the black ink container 3, and FIG. 5 is a sectional view of the color ink container 4. Incidentally, the internal structures of the black and color ink containers 3 and 4 in this embodiment, which will be described next, are not intended to limit the scope of the present invention.

First, the black ink container 3 for black ink will be described with reference to the drawings.

As shown in FIG. 4, the container proper 31 of the black ink container 3 contains an absorbent member 34 as an ink retaining member, and an ink delivery member 35. This ink retaining member 34 absorbs and retains black ink. The ink delivery member 35 is positioned between the absorbent member 34 and ink outlet 33, with its top surface being airtightly in contact with the absorbent member 34 so that ink outlet 33 is sealed at the inward end.

The absorbent member 34 and ink delivery member 35 are both capable of absorbing and retaining ink. In terms of the ink retainment property (capillarity), however, the ink delivery member 35 is made greater than the absorbent member 34. With this setup, the ink retained in the absorbent member 34 is smoothly drawn into the ink delivery member 35, improving thereby the efficiency with which the ink remained in the absorbent member 34 is consumed.

As the material for the absorbent member 34 and ink delivery member 35, fiber formed of thermoplastic resin such as poly-olefin was used. More specifically, a certain number of pieces of web formed by arranging thermoplastic fibers virtually in parallel were layered, and compressed in the direction perpendicular to the webs. As the material for the absorbent member 34, the fibrous material, which was roughly 6.7 [dtex] in the fiber thickness, was compressed to a density of roughly 0.09 [g/cm$^3$] was used. As for the material for the ink delivery member 35, fibrous material, which was roughly 2.2 [dtex] in the fiber thickness, was compressed to a density of roughly 0.20 [g/cm$^3$].

Incidentally, the container proper 31 and lid 32 of the ink container 3 (4) in this embodiment are formed of resinous material, in particular, poly-olefin, that is, the same material as the material for the absorbent member 34 and ink delivery member 35, due to environmental concerns, more specifically, in order to drastically improve the amount by which the ink container 3 (4) can be recycled or reused.

The black ink container 3 is structured so that it can be removably mounted in the ink container holder 5. More concretely, the black ink container 3 is provided with a locking claw 36 for preventing the black ink container 3 from dislodging from the ink container holder 5 after the mounting of the black ink container 3 into the ink container holder 5. The locking claw 36 is an integral part of the black ink container 3 and projects from the bottom of the front wall of the black ink container 3, in terms of the direction in which black ink container 3 is inserted into the ink container holder 5. The locking claw 36 engages with the black ink container locking hole 26 of the ink container holder 5, and keeps the black ink container 3 solidly secured to the ink container holder 5.

The black ink container 3 is also provided with a latching lever 37, which engages with the ink container holder 5. The latching lever 37 is also an integral part of the black ink container 3, being on the side opposite to where the locking claw 36 is present. It is elastically bendable in the direction indicated by an arrow mark a1 in FIG. 4, and springs back into the original position in the direction indicated by an arrow mark a2 in FIG. 4. It is attached to the bottom wall portion of the container proper 31 of the black ink container 3 by its base port-ion, and has a latching claw 38, which is on the outward surface of the top portion of the latching lever 37. The latching claw 38 engages with the ink container holder 5.

The latching lever 37 projects at a predetermined angle from the bottom portion of the container proper 31, so that the distance between the latching lever 37 and the container proper 31 gradually increases toward the top portion of the black ink container 3. It is provided with a finger placement spot 39 by which the latching lever 37 is to be pressed toward the container proper 31 in order to elastically deform the latching lever 37 when disengaging the latching claw 38 from the ink container holder 5. The finger placement spot 39 is located at the tip of the latching lever 37.

When the black ink container 3 is mounted into the ink container holder 5, the latching lever 37 comes into contact with the rear lateral wall 21 of the ink container holder 5, being thereby elastically bent by the wall 21 in the direction indicated by the arrow mark a1 in FIG. 4, and the latching claw 38 of the latching lever 37 engages with the latching lever locking hole 27 of the ink container holder 5, which will be described later.

Next, the color ink container 4 for the recording head 1 will be described. The structure of the color ink container 4 is basically the same as the above described structure of the black ink container 3 shown in FIGS. 1, 2, and 3.

Referring to FIG. 5, the color ink container 4 in this embodiment comprises a container proper 31, in the form of a topless box, in which three inks different color are held, and a lid 32 which covers the opening (unshown) of the container proper 31.

The container proper 31 has three independent chambers which are separated by two parallel partitioning walls 41, and in which three inks different in color are held one for one. The two parallel partitioning walls 41 are positioned perpendicular to the two parallel lateral walls of the color ink container 4, by which the lateral movements of the color ink container 4 are controlled when the container 4 is mounted into the ink container holder 5. Thus, the three chambers are parallel to each other, and overlap with each other in the lengthwise direction of the bottom wall of the container 4.

The three chambers contain absorbent members 34Y, 34M, and 34C, which absorb and retain yellow, magenta, and cyan inks, respectively. The bottom wall of the color ink container 4 has ink outlets 33Y, 33M, and 33C, which lead to three chambers, one for one, and the openings of which are aligned in the lengthwise direction of the bottom wall.

The structures of the three chambers are the same as the above described structure of the black ink container 3, and therefore, they will be not described here.

Also in the case of the color ink container 4, fiber formed of thermoplastic resin such as poly-olefin is used as the material for the absorbent members 34 and ink delivery member 35. More specifically, a certain number of pieces of web formed by arranging thermoplastic fibers virtually in parallel are layered, and compressed in the direction perpendicular to the webs. For the absorbent member 34, the fibrous material, which was roughly 6.7 [dtex] in the fiber thickness, was compressed to a density of roughly 0.07–0.09 [g/cm$^3$]. For the ink delivery member 35, fibrous material, which was roughly 2.2 [dtex] in the fiber thickness, was compressed to the density of roughly 0.20 [g/cm$^3$].

The lid 32 is also virtually the same as that for the black ink container 3, except that the lid 32 of the color ink container 4 has three air vents 42, one for each chamber, and that it is structured to hermetically separate the three chambers from each other. Therefore, it will not be described here.

The structure for removably securing the color ink container 4 to the ink container holder 5 is the same as the above described structure for the black ink container 3; it comprises a locking claw, and a latching lever with a latching claw as does that of the black ink container 3. Referring to FIG. 1(*b*), the ink outlets 33Y, 33M, and 33C are aligned in the direction parallel to the plane which includes the center lines of the latching claw 38 and locking claw 36, and which is perpendicular to the bottom wall of the color ink container 4. Further, they are positioned closer to one of the lateral walls (walls parallel to ink container insertion direction) of the color ink container 4 than the other.

In other words, the ink outlets 33, the presence of which are likely to weaken the mechanical strength of the areas of the bottom wall of the color ink container 4, in which they are positioned, are positioned in the adjacencies of one of the ridges which the bottom wall and one of the lateral walls of the container proper 31, that is, the portion of the container proper 31 which is relatively high in rigidity. Therefore, the amount by which the container proper 31 is reduced in mechanical strength by the presence of the ink outlets 33 is minimized. Moreover, the two portions (locking claw 36 and latching claw 38) for securing the black ink container 3 and color ink container 4 to the ink container holder 5 are also positioned in the adjacencies of one of the lateral walls of the container proper 31 as are the ink outlets 33. Therefore, the black ink container 3 and color ink container 4 can be reliably mounted into the ink container holder 5, without causing the ink containers 3 and 4 to become twisted, and can be solidly secured to the ink container holder 5 in spite of the presence of only a small number of ink container locking means.

In particular, aligning the ink container securing means and ink outlets in a single plane as in this embodiment, minimizes the amount by which the ink containers are twisted when the ink containers are mounted into the ink container holder. In other words, with the provision of the above described structural arrangement, even if an ink container is provided with two or more ink outlets, the ink container can be reliably mounted into the ink container holder, without becoming substantially twisted, as long as the ink outlets are aligned in the same manner as those of the color ink container in this embodiment. Further, positioning the ink container securing means in the adjacencies of one of the lateral walls of the container proper makes it possible to place the ink container positioning mechanism on the area of the container proper, which is relatively high in mechanical strength, making it therefore possible to obtain an ink container reliably mountable in the ink container holder, that is, making it possible to obtain an ink container, the ink outlets 33 of which are reliably connected to the ink delivery tubes 23. The above described structural arrangement for an ink container is extremely beneficial for reducing the thickness of the walls of an ink container in order to increase the internal volume of the ink container without increasing its external size.

Incidentally, not only does "aligning the container locking means and ink outlets in a single plane" means that the axial lines of the openings of the ink outlets 33 coincides with the plane which includes the center lines of the locking claw 36 and latching claw 38, but also that they coincide with the line connecting the centers of the ink locking claw 36 and latching claw 38.

Referring to FIG. 2(*a*), the black ink container 3 is provided with a guiding projection 43, which is on only one of the lateral walls of the black ink container 3, which is parallel to the ink container insertion direction, and the color ink container 4 is also provided with a guiding projection 43, which is also on only one of the lateral walls of the color ink container 4, which are parallel to the ink container insertion direction. The guiding projection 43 of the black ink container 3 guides the black ink container 3 along the guiding rail 28 of the ink container holder 5 when the black ink container 3 is mounted into the ink container holder 5, and the guiding projection 43 of the color ink container 4 guides the color ink container 4 along the guiding rail 29 of the ink container holder 5 when the color ink container 4 is mounted into the ink container holder 5.

Next, the ink container holder 5 in this embodiment will be described in detail with reference to the drawings.

Referring to FIGS. 1, 2, and 3, the ink container holder 5 is roughly in the form of a topless box having the first ink container compartment 11 in which the black ink container 3 holding black ink is removably mounted, and the second ink container compartment 12 in which the color ink container 4 holding color inks is removably mounted. The first and second ink container compartments 11 and 12 are positioned next to each other, and are effected by the lateral walls 21 of the ink container holder 5 and a partitioning wall 22. That is, the space surrounded by the lateral walls 21 of the ink container holder 5 is divided by the partition wall 22, into two sub-spaces, or two compartments, into which the black ink container 3 and color ink container 4 are mounted one for one.

Referring to FIG. 1(*b*), one of the lateral walls 21 of the ink container holder 5 (left lateral wall in FIG. 1(*b*)), which is parallel to the direction in which the black ink container 3 is mounted into the first ink container compartment 11, is provided with the guiding rail 28, which smoothly guides the black ink container 3, while regulating the movement thereof, when the black ink container 3 is mounted into, or removed from, the ink container holder 5.

Also referring to FIG. 1(*b*), the partitioning wall 22 of the ink container holder 5 is shaped so that its top edge functions as the guiding rail 29 which smoothly guides the color ink container 4 into the second ink container compartment 12, while regulating the movement of the color ink container 4, when the color ink container 4 is mounted into, or removed from, the ink container holder 5.

In other words, the ink container holder 5 is provided with only two guiding rails, that is, one guiding rail 28 and one guiding rail 29. The guiding rail 28 is on one of the lateral walls of the ink container holder 5, parallel to the ink container insertion direction, and the guiding rail 29 is the specifically contoured top edge of the partitioning wall 22 of the ink container holder 5. Therefore, the ink container 3 (4) is guided from only one side, in terms of the ink container insertion direction. The guide rail 28 (29) has a horizontal portion which is roughly parallel to the bottom wall of the ink container holder 5, and a tilted portion which is tilted downward, in terms of the direction perpendicular to the bottom wall of the ink container holder 5, as seen from the trailing side in terms of the ink container insertion direction. The horizontal and tilted portions are continual.

As the ink container 3 (4) is mounted into the ink container holder 5, they are guided, horizontally as well as diagonally downward, by the guide rail 28 (29), respectively, until the container 3 (4) reaches the bottom wall of the ink container compartment 11 (12).

The role of the guide rail 28 (29) is to regulate the movement of the ink container 3 (4) in order to prevent the problem that when the ink container 3 (4) is mounted into the first (second) ink container compartment 11 (12), the ink container holder 5 is damaged due to the contacts between the ink container 3 (4) and the ink delivery tubes 23 of the ink container holder 5. More specifically, the ink delivery tube 23 of the first ink container compartment 11, that is, the space for the black ink container, is located roughly at the center of the bottom wall of the first ink container compartment 11, in terms of the lengthwise direction of the compartment 11, which is parallel to the ink container insertion direction. In comparison, the three ink delivery tubes 23, one for each color ink, of the second ink container compartment 12, that is, the space for the color ink container 4, are aligned in the ink container insertion direction. Thus, the possibility that the color ink container 4 will come into contact with the ink delivery tubes 23 of the ink container compartment 12 is greater than the possibility that the ink container 3 will come into contact with the ink delivery tube 23 of the ink container compartment 11. Therefore, in this embodiment, the guiding rail 28 for the black ink container 3 is made different in shape from the guiding rail 29 for the color ink container 4, optimizing thereby the movement of the ink container 3 (4) in order to prevent the ink container 3 (4) from coming into contact with the ink delivery tubes 23.

The first (second) ink container compartment 11 (12) of the ink container holder 5 is provided with a locking hole 26, into which the locking claw 36 of the ink container 3 (4) engages, and which is virtually at the bottom (in immediate adjacencies of bottom wall). The first (second) ink container compartment 11 (12) of the ink container holder 5 is provided with a locking hole 27, into which the latching claw 38 of the latching lever 37 of the ink container 3 (4) engages. The locking hole 27 is located at the opposite end of the ink container holder 5 from the locking hole 26. The top edge of the this wall of the ink container compartment 11 (12) of the ink container holder 5 having the locking hole 27 functions as a second guiding portion, which comes into contact with the bottom wall of the ink container 3 (4), guiding thereby the ink container 3 (4) while controlling the movement thereof, when the ink container 3 (4) is mounted into the ink container compartment 11 (12) of the ink container holder 5.

Next, the movement of the ink container 3 (4), which occurs as it is mounted into the ink container holder 5, will be described.

Figure 6:
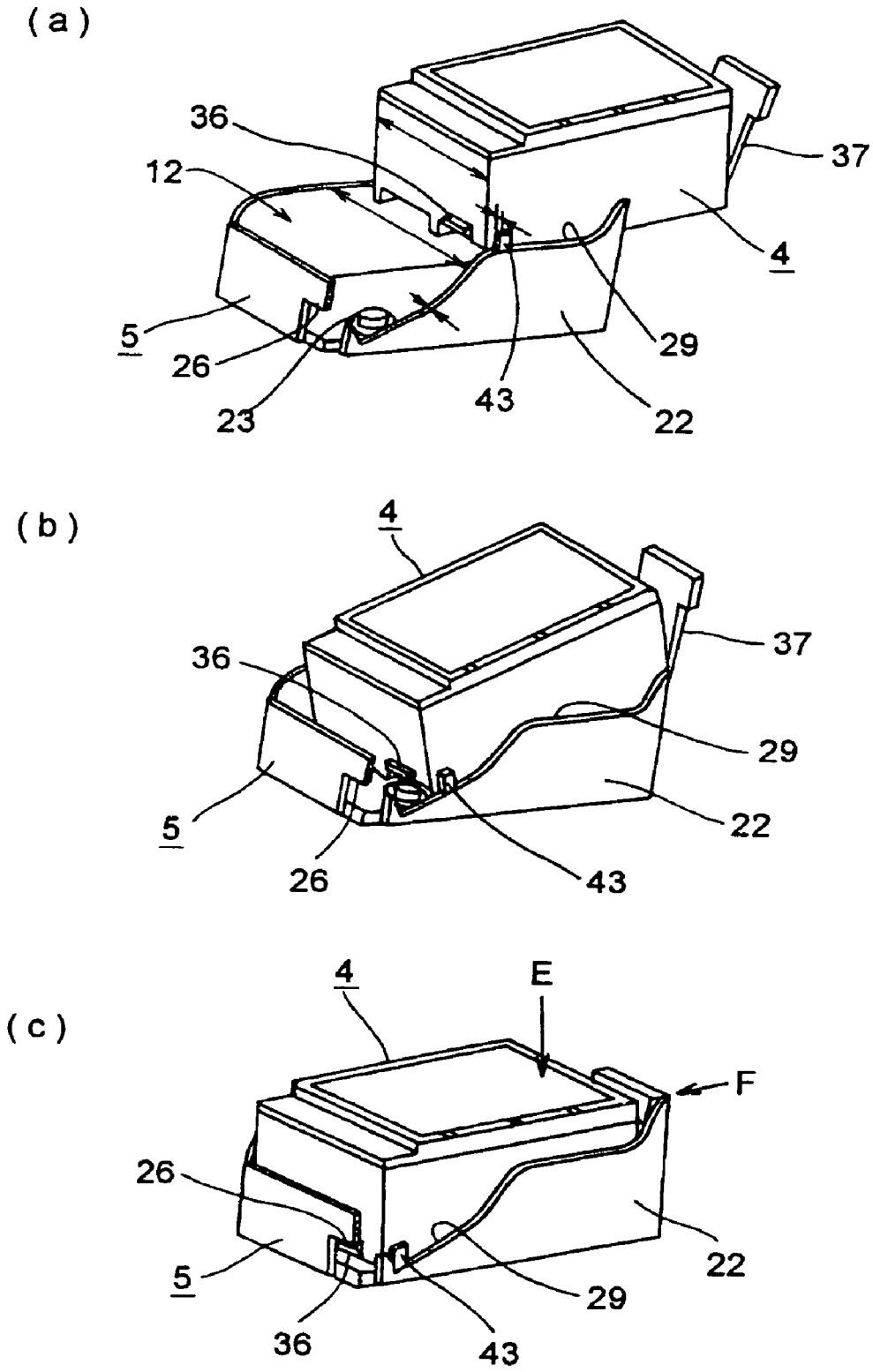
FIG. 6 is a perspective view of the combination of the ink container and ink container holder, showing in sequence the steps for mounting the ink container into the ink container holder.

FIG. 6 is a perspective view of the combination of the color ink container 4 and ink container holder 5, showing the movement of the color ink container 4, which occurs during the mounting of the color ink container 4 into the ink container holder 5.

The movement of the color ink container 4, which occurs during the mounting into the ink container holder 5, is basically the same as that of the black ink container 3. Thus, only the movement of the color ink container 4, which occurs during the mounting of the color ink container 4 into the ink container holder 5, will be described; the movement of the black ink container 3 will not be described.

FIG. 6(*a*) shows the color ink container 4 in the initial stage of the mounting of the color ink container 4 into the ink container holder 5, and FIG. 6(*b*) shows the color ink container 4 in the middle stage of the mounting of the color ink container into the ink container holder 5, in which the ink container 4 is being guided by the guiding rail 29 of the ink container holder 5. FIG. 6(*c*) shows the color ink container 4 in the final stage of the mounting of the color ink container 4 into the ink container holder 5, in which the color ink container 4 has just been completely mounted into the ink container holder 5.

First, referring to FIG. 6(*a*), as the color ink container 4 is inserted into the ink container holder 5, from the front wall side, that is, the side opposite to the latching lever 37, the guiding projection 43 of the color ink container 4, which projects a predetermined distance from the bottom end of the front wall of the color ink container 4, comes into contact with the guiding rail 29 of the ink container holder 5.

Next, referring to FIG. 6(*b*), as the color ink container 4 is further inserted, the guiding projection 43 slide on the guiding rail 29, with the rear end portion of the color ink container 4 being in contact with the walls of the ink container holder 5, that is, being supported by the wall of the ink container holder 5, which is in contact with the color ink container 4 by its top edge. Further, the front portion of the color ink container 4 is supported by the guiding rail 29, by the guiding projection 43 of the container 4. Therefore, all that is necessary to smoothly mount the color ink container 4 into the ink container holder 5 is to simply push the color ink container 4 into the ink container holder 5.

The color ink container 4 and ink container holder 5 are designed so that there will be a predetermined amount of clearance between each of the aforementioned lateral walls of the color ink container 4 and the corresponding wall of the ink container holder 5 when mounting the former into the latter. Therefore, when mounting the color ink container 4 into the ink container holder 5, the color ink container 4 tends to slightly wobble in the direction (left and right direction in FIG. 1(*b*)) perpendicular to the cartridge insertion direction, in the second ink container compartment 12 of the ink container holder 5.

However, this slight wobble of the color ink container 4 in the direction perpendicular to the lateral walls of the color ink container 4, which occurs while the color ink container 4 is mounted into the ink container holder 5, is regulated by one of the lateral walls 21 of the ink container holder 5, a part of which constitutes one of the lateral walls of the second ink container compartment 12, and the portioning wall 22 having the guiding rail 29. More specifically, it is regulated by the inward surface of the above described wall 21 of the ink container holder 5, and one of the surfaces of the partitioning wall 22. Further, as described above, the guiding projection 43 is specifically positioned so that the bottom wall of the color ink container 4 does not interferes with (contacts) the ink delivery tubes 23, etc., of the bottom wall of the ink container holder 5. In other words, with the provision of the above described structural arrangement, it is unnecessary for the color ink container 4 to be modified in external shape, in consideration of the interference between the color ink container 4 and the components of the ink container holder 5, that is, in order to prevent the color ink container 4 from interfering with the ink delivery tubes 23, etc., of the second ink container compartment 12 of the ink container holder 5; it is unnecessary for the color ink container 4 to be given such an external shape that reduces the internal volume of the color ink container 4. Therefore, the color ink container 4 in this embodiment can be smoothly mounted into, or removed from, the ink container holder 5, even though its internal volume is just as large as a color ink container in accordance with the prior art.

As described above, the distance by which the guiding projection 43 of the color ink container 3 (4) projects from the external surface of the ink container 3 (4), must be large enough to assure that the projection 43 will engage with the guiding rail 28 (29) to correctly guide the ink container 3 (4) when the ink container 3 (4) is mounted into, or removed from, the ink container holder 5. On the other hand, increasing the distance by which the guiding projection 4 projects increases the possibility that the projection 43 will come into contact with the vertical wall of the ink container holder 5 and/or the lateral wall of the ink container in the adjacent ink container compartment. Such contacts between the projection 43 and the vertical wall of the ink container holder 5 and the lateral wall of the ink container in the adjacent ink container compartment generate friction, that is, container restraining force, which interferes with the insertion of the ink container 3 (4) into the ink container holder 5. Therefore, the distance by which the projection 43 projects must be set to be large enough to assure that it will not fail to rest on the guide rail 28 (29), but small enough not to cause unnecessary interferences.

In other words, the ink container 3 (4), and ink container holder 5 are desired to be structured to satisfy the following inequality (FIG. 6):

$$D>C>(B-A) \qquad \text{(Inequality 1)}$$

A: external dimension (exclusive of guiding projection 43) of container proper 31, in terms of the direction parallel to the direction in which ink container 3 (4) is inserted into the ink container holder 5;

B: internal dimension of the first (second) ink container compartment 11 (12) of the ink container holder 5, in terms of the direction parallel to the direction in which ink container 3 (4) is inserted into the ink container holder 5;

C: distance by which the projection 43 on one of the lateral walls of the ink container 3 (4) projects from the lateral wall; and D: thickness of the guiding rail 28 (29) of the ink container holder 5.

With the measurements of A–D set to satisfy Inequality 1, it is assured that when ink container 3 (4) is mounted into, or removed from, the first (second) ink container compartment 11 (12) of the ink container holder 5, the guiding projection 43 of the ink container 3 (4) will properly rest the guiding rail 28 (29) of the ink container holder 5, and will be smoothly guided by the guiding rail 28 (29) without becoming disengaged therefrom. Further, the aforementioned contacts which interfere with the mounting of the ink container 3 (4) into the first (second) ink container compartment 11 (12) do not occur.

Further, as described above, the ink container 3 (4) slightly wobbles left and right when it is mounted into the ink container holder 5. Even though this wobbling movement of the left (right) side of the ink container 3 (4) having the guiding projection 43 which is guided by the guiding rail 28 (29), perpendicular to the bottom wall of the first (second) ink container compartment 11 (12), is properly regulated, the wobbling movement of the right (left) side of the ink container 3 (4), that is, the side opposite to where the guiding rail 28 (29), perpendicular to the bottom wall of the first (second) ink container compartment 11 (12), is not regulated. Therefore, when the ink container 3 (4) is mounted into the ink container holder 5, it becomes slightly tilted relative to one of the lateral walls 21 of the ink container holder 5, and the partition wall 22 of the ink container holder 5. Naturally, therefore, the shape of the guiding rail 28 (29) and the shape of the guiding projection 43 are desired to be designed in consideration of the angle at which the ink container 3 (4) tilts as described above.

In particular, in the case of an structural arrangement in which the ink outlets 33Y, 33M, and 33C are positioned closer to one of the lateral walls of the ink container holder 5, parallel to the ink container insertion direction, it is desired that the lateral wall of the ink container holder 5 closer to the ink outlets 33Y, 33M, and 33C is provided with a guiding mechanism similar to the aforementioned guiding projection of the ink container 3 (4), the guiding rail 28 (29) of the ink container holder 5, etc.

Further, it is possible for the guiding projection 43, with which the ink container 3 (4) is provided, to be deformed by the external force to which the ink container is subjected when the ink container is mounted into, or removed from, the ink container holder 5. Therefore, in order to improve the ink container 3 (4) in terms of operational reliability, it is desired that the guiding projection 43 is attached to the area of the ink container 3 (4), which is relatively greater in mechanical strength, for example, the joint between the external walls of the ink container 3 (4), more specifically, the joint between the front wall and one of the two side walls of the ink container 3 (4), parallel to the ink container insertion direction.

Referring to FIG. 6 (*c*), the mounting of the color ink container 4 ends as soon as the color ink container 4, which is being pushed into the ink container holder 5, comes into contact with the bottom wall of the ink container holder 5, by virtually the entirety of its bottom surface. As will be evident from FIG. 6, during the insertion of the color ink container 4 into the ink container holder 5, the locking claw 36 located at the bottom end of the front wall of the color ink container 4 is inserted into the locking hole 26 of the ink container holder 5.

Then, the rear portion of the color ink container 4 is to be pushed in the direction indicated by an arrow mark E shown in FIG. 6(*c*). As the rear portion is pushed in the above described direction, the color ink container 4 rotates about the locking claw 36 in the locking hole 26. As a result, the latching lever 37 is forced into the ink container holder 5, and the latching claw 38 of the latching lever 37 latches with the edge of the latching hole 27, assuring that each of the ink outlets 33 of the color ink container 4 will remain properly connected to the corresponding ink delivery tubes 23 of the ink container holder 5.

When the color ink container 4 is mounted into the ink container holder 5 as described above, it is assured that the ink delivery tubes 23 of the ink container holder 5 come into contact with the ink holding members (ink delivery member 35) in the ink outlets 33 of the color ink container 4, one for one, and ink is reliably supplied to the recording head. Also, when the color ink container 4 is mounted into the ink container holder 5 as described above, each of the elastic members 25 fitted around the ink delivery tubes 23, one for one, is compressed in its thickness direction, that is, the direction perpendicular to the bottom wall of the ink container holder 5, airtightly sealing the adjacencies of the peripheral surface of each ink outlet 33 of the color ink container 4 and the adjacencies of each ink delivery tube 23 of the ink container holder 5. Therefore, should ink leaks from between one of the ink outlets 33 of the color ink container 4 and the corresponding ink delivery tube 23 of the ink container holder 5, the ink will be confined in the immediate adjacencies of the joint between the ink outlet 33 and ink delivery tube 23.

On the other hand, when removing the color ink container 4 from the ink container holder 5, the latching lever 37 is to be pushed in the direction indicated by an arrow mark F shown in FIG. 6(*c*). As the latching lever 37 is pushed as described above, the latching claw 38 disengages from the edge of the latching hole 27 of the ink container holder 5, allowing the color ink container 4 to be pulled out of the ink container holder 5 by grasping the rear end portion of the color ink container 4. Then, as the color ink container 4 is pulled outward, the locking claw 36 of the color ink container 4 comes out of the locking hole 26, and the color ink container 4 comes out of the ink container holder 5 in its entirety. Obviously, even when the color ink container 4 is pulled out of the ink container holder 5, the movement of the guiding projection 43 (ink container 4) is regulated by the guiding rail 29, and therefore, the ink delivery tubes 23 do not interfere with the movement of the color ink container 4.

As described above, according to this embodiment, when mounting the ink container 3 (4) of the recording head cartridge 1 into the ink container holder 5 of the recording head cartridge 1, or removing the ink container 3 (4) from the ink container holder 5, one side of the ink container 3 (4) is guided by the guiding rail 28 (29), and the other side is directly regulated (guided) by one of the lateral walls of the ink container holder 5. Therefore, it is assured that the ink container 3 (4) will not be incorrectly mounted into the ink container holder 5.

Also according to this embodiment, the guiding rails 28 and 29, and the guiding projections 43, of the recording head cartridge 1, which are for preventing the ink container 3 (4) from being incorrectly mounted into the ink container holder 5, need to be provided only on one side of the ink container holder 5 and ink container 3 (4), respectively, in terms of the ink container insertion direction, making it unnecessary to provide the guiding rail 28 (29), and the guiding projection 24, on both sides of the ink container holder 5 and ink container 3 (4), respectively, in terms of the ink container insertion direction, as in the case of a recording head cartridge in accordance with the prior art. In other words, the space necessary for one of the two sets of the guiding rails and guiding projections, which the prior art requires, can be eliminated to reduce in size the ink container 3 (4) and ink container holder 5 of a recording head cartridge.

Also according to this embodiment, the top edge of the partitioning wall 22 of the ink container holder 5, is utilized as the guiding rail 29, making it possible to reduce in size the ink container 3 (4), and ink container holder, of a recording head cartridge, compared to a recording head cartridge, in accordance with the prior art, in which the guiding rail is independent from the partitioning wall.

In other words, according to this embodiment, even a recording head cartridge, the black ink container 3 and color ink container 4 of which are different in their movements which occur when they are mounted into the ink container holder 5, can be reduced in size while assuring that the recording head and the like will not be damaged by incorrect mounting of the black ink container 3 or color ink container 4.

Incidentally, in the case of the above described embodiment, the latching lever 37 is employed as a means for securing the ink container 3 (4) to the ink container holder 5. However, the application of the present invention does not need to be limited to a recording head cartridge employing a latching lever as the means for securing an ink container to an ink container holder. That is, the present invention is applicable to any recording head cartridge which efficiently regulates the movement of an ink container with the use of guiding rail, whether the lever of the ink container locking mechanism is on the ink container side, or ink container holder side, or whether the ink container securing system employs the locking lever or not.

Further, this embodiment is described with reference to the ink container which contains an ink absorbing member formed of fibrous material. The application of the present invention, however, does not need to be limited to such an ink container. For example, the material for the ink absorbing member may be formed of one of the known foamed material such as foamed urethane. Moreover, the application does not need to be limited to an ink container containing an absorbent member.

Further, the liquid to be held in an ink container does not need to be limited to the aforementioned black, cyan, magenta, and yellow inks. For example, it may be the liquid for forming a printed circuit, or the like liquid.

Embodiment 2

Next, the recording head cartridge in the second embodiment of the present invention will be described with reference to the appended drawings. The recording head cartridge in this embodiment is basically the same in structure as the above described recording head cartridge 1 in the first embodiment. Therefore, the components, portions, etc., of the recording head in this embodiment, which are the same as those in the first embodiment, will be given the same referential symbols as those given for the description of the first embodiment, and will not be described here.

Figure 7:
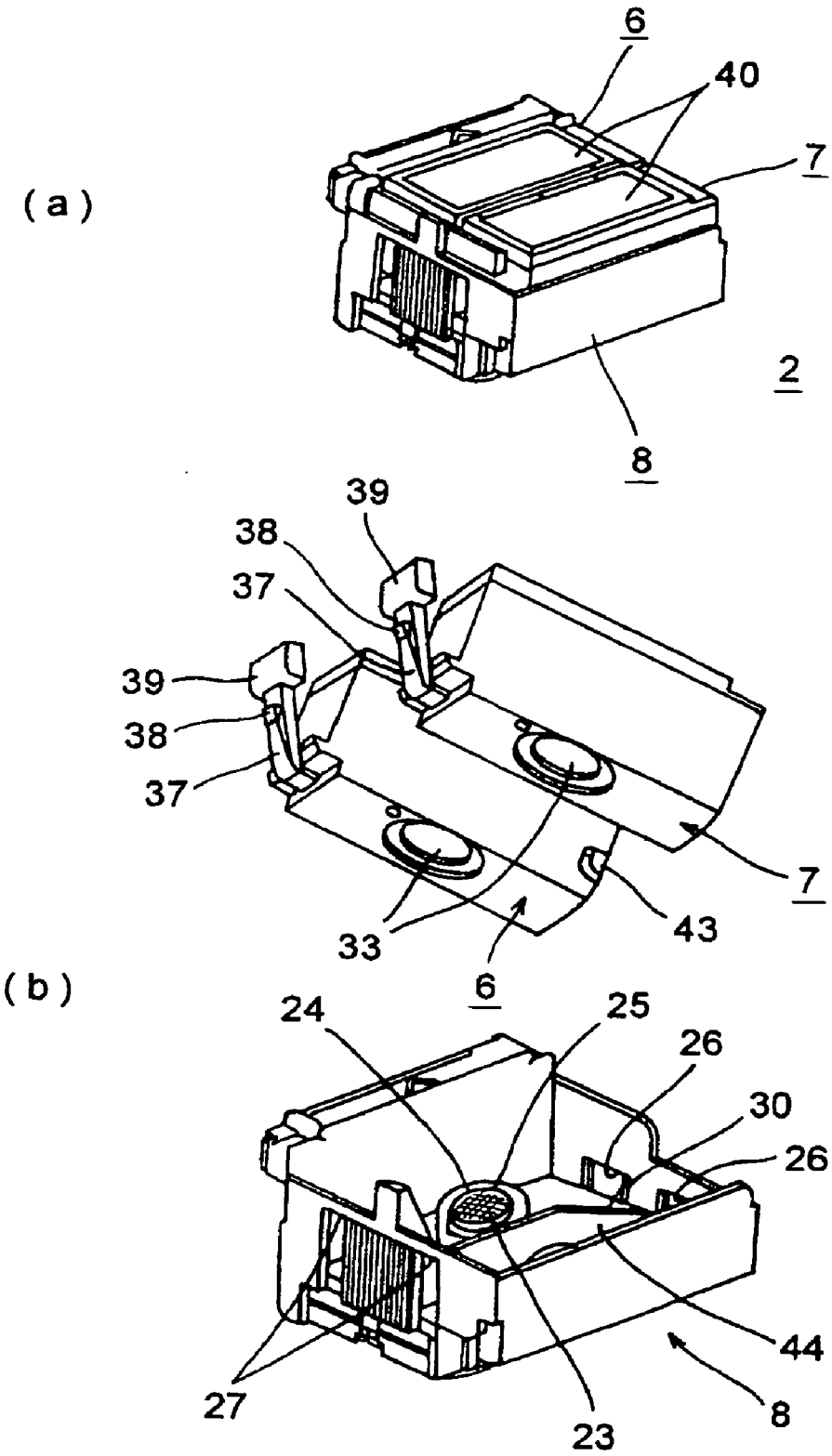
FIG. 7 is a perspective view of the ink jet recording head cartridge in the second embodiment of the present invention.
Figure 8:
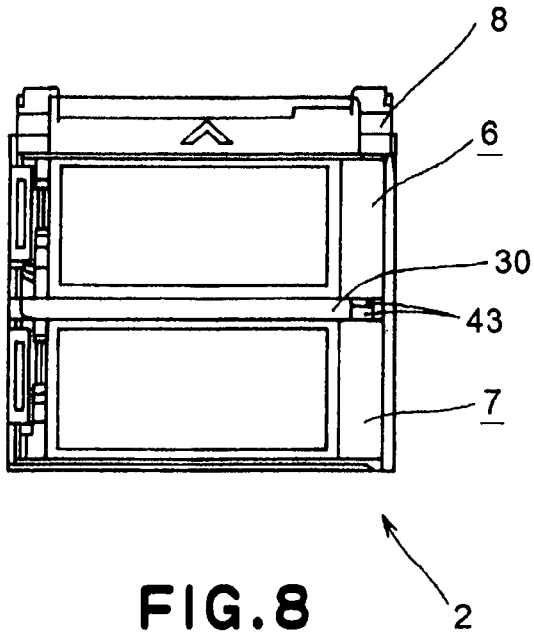
FIG. 8 is a plan view of the ink jet recording head cartridge shown in FIG. 7; (a) showing the ink container in the ink container holder, and (b) showing the ink container having been removed from the ink container holder.
Figure 9:
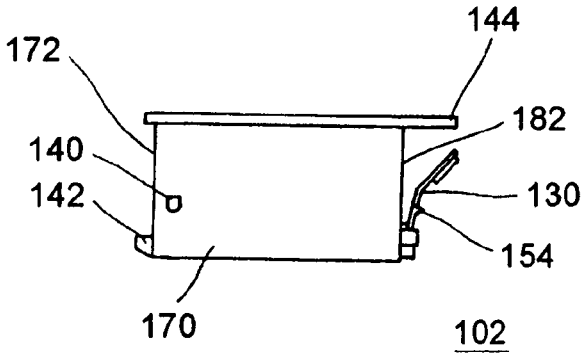
FIG.9 (PRIOR ART)
FIG. 9 is a side view of an ink container in accordance with the prior art.
Figure 10:
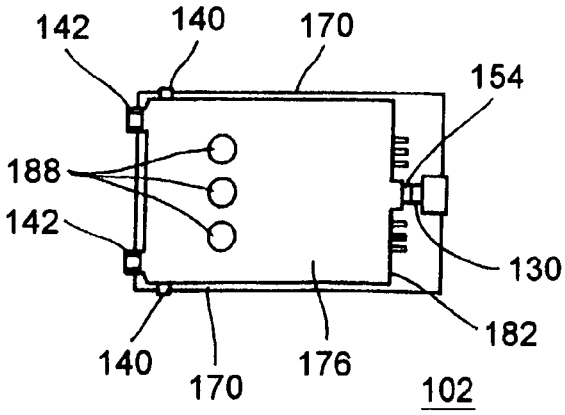
FIG.10 (PRIOR ART)
FIG. 10 is a bottom plan view of the ink container in accordance with the prior art.
Figure 11:
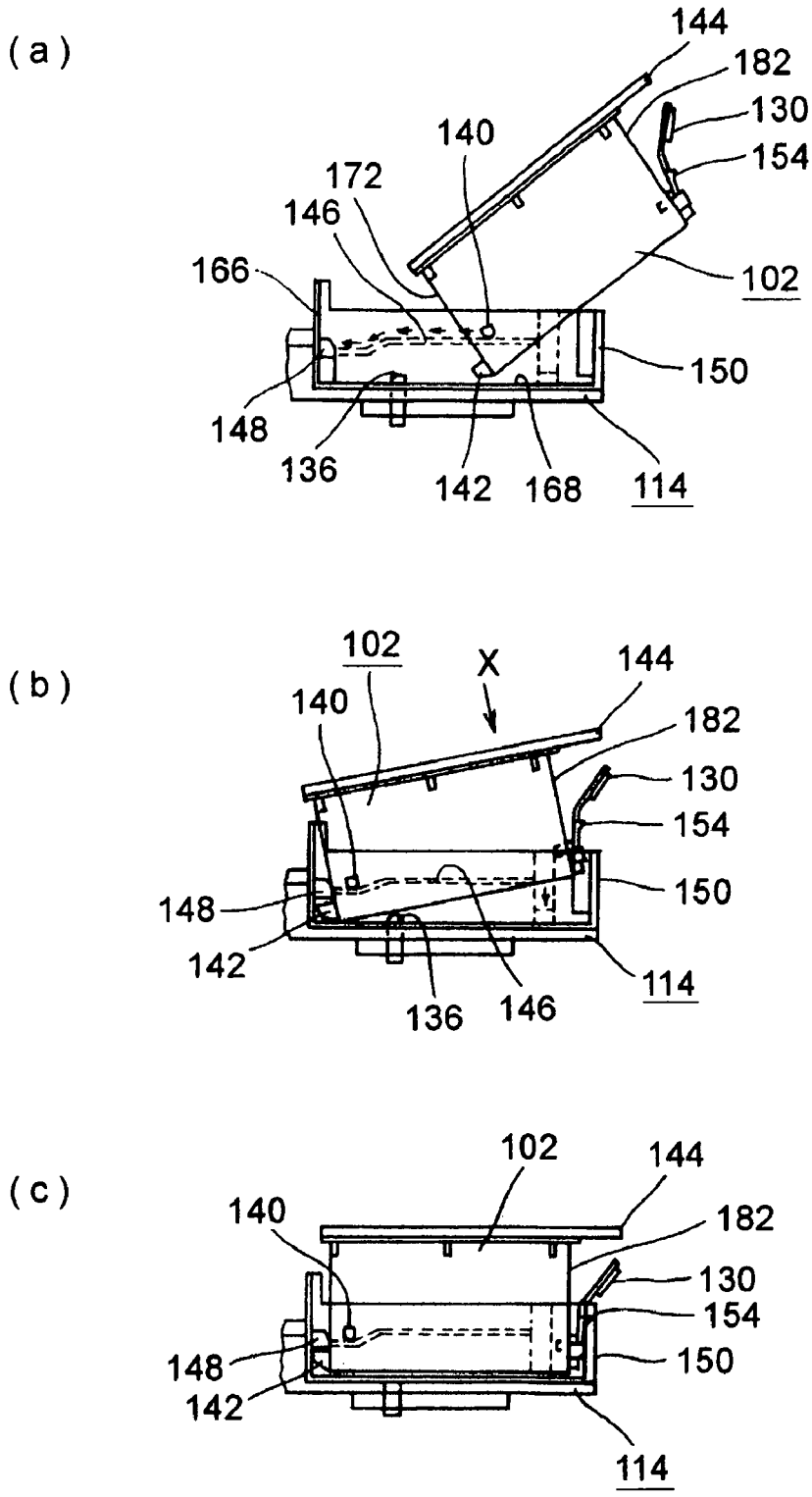
FIG. 11 (PRIOR ART)
FIG. 11 is a phantom side view of the combination of the ink container and ink container holder in accordance with the prior art, showing in sequence the steps for mounting the former into the latter; (a) showing the ink container which has just begun to be mounted into the ink container holder, (b) showing the ink container which is being mounted into the ink container holder, and (c) showing the ink container having just been completely mounted into the ink container holder.

FIG. 7 is a perspective view of the recording head cartridge and ink container holder in this embodiment. FIG. 7(*a*) shows the ink container which is not in the ink container holder, and FIG. 7(*b*) shows the pair of ink containers, and the ink container in which the ink containers are to be mounted. FIG. 8 is a plan view of the recording head cartridge.

The recording head cartridge 2 in this embodiment comprises: a recording head (unshown) for ejecting ink; a pigment ink container 6 which holds pigment black ink to be supplied to the recording head; a dye ink container 7 which holds dye black ink to be supplied to the recording head; and an ink container holder 8 in which the ink containers 6 and 7 are removably mounted.

The ink containers 6 and 7 are roughly the same in shape. The ink container 6 (7) is provided with an ink outlet 33, which is in the middle of the bottom wall of the ink container container proper 31. Therefore, the ink containers 6 and 7 are virtually the same in their movements which occur when they are mounted into the ink container holder 8.

Referring to FIG. 7, each of the pigment black ink container 6 and dye black ink container 7 is provided with a guiding projection 43 for guiding the ink container 6 (7) along the guiding rail 30 of the ink container holder 8 when the ink container 6 (7) is mounted into the ink container holder 8. The guiding projection 43 is on only one side of the ink container 6 (7), more specifically, the partitioning wall 44 side of the ink container 6 (7) in terms of the ink container insertion direction. The guiding rail 30 is the top edge of the partitioning wall 44 of the ink container holder 8, and is shared by the ink containers 6 and 7.

Structuring the ink containers 6 and 7, and the ink container holder 8, so that the guiding rail 30, that is, the top edge of the partitioning wall of the ink container holder 8, is shared by the two containers 6 and 7, makes the thickness of the partitioning wall 44 equal to roughly twice the distance by which the guiding projection 43 of the ink container 6 (7) projects, increasing therefore the mechanical strength of the partitioning wall 44. Further, with the provision of such a structural arrangement, if the ink container 6 (7) is inserted into the wrong ink container compartment, the guiding projection 43 of the ink container 6 (7) comes into contact with the lateral wall 21 of the ink container compartment 11 (12) of the ink container holder 8, making it virtually impossible to insert the ink container 6 (7) further into the ink container holder 8. In other words, the above described structural arrangement makes it possible to prevent the ink container 6 (7) from being mounted into the wrong ink container compartment.

Incidentally, this embodiment was described with the structural arrangement in which the guiding rail 30, that is, the specifically contoured top edge of the partitioning wall 44 of the ink container holder 8 was shared by the ink containers 6 and 7, which are mounted next to each other. However, the two guiding rails different in contour, as those in the first embodiment, may be provided as integral parts of the partitioning wall 44 of the ink container holder 8.

Further, this embodiment was described with reference to the recording head which comprises two ink containers, and the ink container holder in which the two ink container are mounted. However, this embodiment is also applicable to a recording head comprising three or more ink containers, for example, black, cyan, magenta, and black ink containers, which are independent from each other.

As described above, according to the present invention, the guiding projection for guiding a liquid container when mounting the liquid container into a liquid container holder has to be on only one of the two lateral walls, parallel to the direction in which the liquid container is inserted into the liquid container holder, of the liquid container. In other words, the space occupied by one of the pair of guiding projections on the two lateral walls, parallel to the liquid container insertion direction, of a liquid container in accordance with the prior art, can be eliminated. Therefore, not only is it possible to reduce the size of a liquid container while assuring that the liquid container is reliably mounted into a liquid container holder, but also to assure that even if the liquid container is incorrectly mounted into a liquid container holder, the liquid container holder, etc., are not damaged.

While the invention has been described with reference to the structures disclosed herein, it is not confined to the details set forth, and this application is intended to cover such modifications or chances as may come within the purposes of the improvements or the scope of the following claims.

What is claimed is:

1. A liquid container detachably mountable to a container holder, said liquid container comprising:

a container body for containing liquid and including a front side engaging portion and a rear side engaging portion for engagement with the container holder, said front side engaging portion and said rear side engaging portion being disposed at a leading side and a trailing side, respectively, with respect to an insertion direction of said container into the container holder, wherein said leading side and said trailing side are connected by a pair of lateral sides which extend in parallel with the insertion direction; and a projection, provided on only one lateral side of said pair of lateral sides of said container body, for being guided, when said container is mounted to the container holder, along an upper end of a guide wall provided in the container holder while the other lateral side is limited by an inner surface of the container holder, and said container is rotated substantially about said front side engaging portion, wherein a bottom surface of said container is provided with a liquid supply outlet for supplying the liquid from said container to an outside thereof; and wherein said liquid supply outlet is disposed at a position downstream in the insertion direction of a middle point of said container, the position being offset toward said one of the lateral sides having said projection.

2. A liquid container according to claim 1, wherein said container holder has a plurality of mounting portions, and a width A of said liquid container measured between substantially parallel lateral surfaces which are substantially parallel with the insertion direction when said liquid container is mounted to said container holder, a distance B between inner surfaces of the container mounting portion opposed to said lateral sides of said liquid container, respectively, a height C of said projection, and a width D of the upper end of said guide wall, satisfy:

$$D>C>(B-A).$$

3. A container according to claim 1, wherein said projection is positioned towards the leading side.

4. A container according to claim 1, wherein the bottom surface of said container is provided with a plurality of said liquid supply outlets which are arranged on a line connecting centers of said front side engaging portion and said rear side engaging portion and which are disposed offset toward said one of the lateral sides having said projection.

5. A container according to claim 1, further comprising an elastically displaceable operation lever which elastically displaces when said container is mounted to or demounted from the container holder, wherein at least one of said front side engaging portion and said rear side engaging portion is formed into said operation lever.

6. A recording head cartridge comprising:

a recording head for ejecting the liquid;

a plurality of liquid containers containing liquid to be supplied into said recording head;

a plurality of container mounting portions for detachably mounting said liquid containers, wherein each said liquid container includes a front side engaging portion and a rear side engaging portion for engagement with said container holder, said front side engaging portion and said rear side engaging portion being disposed at a leading side and a trailing side, respectively, with respect to an insertion direction of said container into said container holder, wherein said leading side and said trailing side are connected by a pair of lateral sides which extend in parallel with the insertion direction; and a projection provided on only one lateral side of said pair of lateral sides of said container body;

wherein said container holder is provided with a front side portion and a rear side portion for engagement with said front side engaging portion and said rear side engaging portion, respectively, and a guide wall, provided only on one of sides to be opposed to said liquid container, for guiding said projection along an upper end thereof;

wherein each said liquid container includes a bottom surface having a liquid supply outlet for supplying the liquid from said container to an outside thereof;

wherein for each liquid container, said liquid supply outlet is disposed at a position downstream in the insertion direction of a middle point of said container, the position being offset toward said one of the lateral sides having said projection;

wherein said container holder is provided with plural ink delivery tubes each positioned for sealed contact in correspondence to a respective one of said liquid supply outlets of said liquid containers; and wherein when each said liquid container is mounted to said container holder, said projection is guided along the upper end of said guide wall, and the other side surface parallel with the insertion direction is limited by an inner surface of said container holder, and is rotated substantially about said front side engaging portion.

7. A recording head cartridge according to claim 6, wherein one of said liquid containers is a black ink container containing black ink, and another one of said liquid containers is a color ink container containing at least three different color inks, and said projection of the black ink container and said projection of the color ink container are opposed to each other.

* * * * *